US007434683B1

(12) United States Patent
Harper et al.

(10) Patent No.: US 7,434,683 B1
(45) Date of Patent: Oct. 14, 2008

(54) PROTECTIVE CASE INCLUDING RIGID SHELL MEMBERS

(75) Inventors: Mike Harper, Saginaw, TX (US); Scott Skurdalsvold, Mansfield, TX (US); Jeffrey Allen Guyer, Dallas, TX (US); Charles Schmucker, Allen, TX (US)

(73) Assignee: Plano Molding Company, Plano, IL (US)

( * ) Notice: Subject to any disclaimer, the term of this patent is extended or adjusted under 35 U.S.C. 154(b) by 232 days.

(21) Appl. No.: 11/259,517

(22) Filed: Oct. 26, 2005

(51) Int. Cl.
*B65D 85/00* (2006.01)
*A45C 13/36* (2006.01)

(52) U.S. Cl. ..... 206/315.11; 190/104; 190/127

(58) Field of Classification Search ..... 206/315.1, 206/315.11, 523, 588–590; 190/103–105, 190/115, 124–127, 106, 109; 383/127
See application file for complete search history.

(56) References Cited

U.S. PATENT DOCUMENTS

| | | | | | |
|---|---|---|---|---|---|
| 1,496,981 | A | | 6/1924 | Dresner | |
| 1,712,448 | A | * | 5/1929 | Eckhardt | 190/103 |
| 1,881,396 | A | * | 10/1932 | Berlin et al. | 190/106 |
| 1,921,110 | A | * | 8/1933 | Wheary | 190/109 |
| 2,018,809 | A | * | 10/1935 | Rodgers | 190/103 |
| 2,475,961 | A | * | 7/1949 | Hilbert | 190/105 |
| 2,502,632 | A | | 4/1950 | Platt | |
| 2,838,085 | A | * | 6/1958 | Beeler | 190/115 |
| 2,872,960 | A | | 2/1959 | Kolpin | |
| 2,932,334 | A | | 4/1960 | Steen | |
| 3,191,652 | A | | 6/1965 | Benson et al. | |
| 3,865,166 | A | * | 2/1975 | Pedro | 206/317 |
| 4,077,451 | A | * | 3/1978 | Zoland | 383/127 |
| 4,129,213 | A | * | 12/1978 | Fleig | 206/523 |
| 4,328,634 | A | | 5/1982 | Wiltrout | |
| 4,887,700 | A | | 12/1989 | Rice | |
| 5,669,495 | A | | 9/1997 | West | |
| 5,832,912 | A | | 11/1998 | Olivarez | |
| 6,119,388 | A | | 9/2000 | Jones et al. | |
| 6,206,261 | B1 | | 3/2001 | McCrary | |
| D448,163 | S | | 9/2001 | Kolpin | |
| D448,165 | S | | 9/2001 | Kolpin | |
| D448,558 | S | | 10/2001 | Kolpin | |
| D448,560 | S | | 10/2001 | Kolpin | |
| D448,561 | S | | 10/2001 | Kolpin | |
| D448,562 | S | | 10/2001 | Kolpin | |
| 6,662,944 | B2 | | 12/2003 | Hagemann et al. | |
| 6,722,496 | B2 | | 4/2004 | Gantert | |
| 6,763,940 | B1 | * | 7/2004 | Lai | 206/315.1 |
| 2005/0056511 | A1 | | 3/2005 | Hsieh | |

* cited by examiner

*Primary Examiner*—Bryon P Gehman
(74) *Attorney, Agent, or Firm*—Vedder Price, P.C.

(57) ABSTRACT

A protective case includes a first shell member and a second shell member connected generally in a clam shell manner. Each shell includes a centrally disposed rigid portion. Each shell member further includes a first flexible portion, which extends from a first side of the rigid portion to adjacent the first side wall boundary of the case, so as to form a portion of the top wall boundary and the bottom wall boundary of the case. A second flexible portion also extends from the second side of the rigid portion to adjacent the second side wall boundary of the case. A zipper is disposed along the top wall boundary and extends from the first side wall boundary to the second side wall boundary. The zipper operatively connects the rigid portion and the flexible portions of the first shell member to the respective corresponding rigid portion and first and second flexible portions of the second shell member.

15 Claims, 4 Drawing Sheets

PROTECTIVE CASE INCLUDING RIGID SHELL MEMBERS

TECHNICAL FIELD OF THE INVENTION

The present invention relates to carrying, storage and transportation cases, and more particularly, to a protective case having rigid and flexible properties.

BACKGROUND OF THE INVENTION

Conventional weapon and firearm carrying cases for carrying guns, rifles, archery bows, or the like, are utilized to carry, transport or ship such items, and are generally constructed in two different forms. One form has a rigid housing, the other form has a soft-walled, deformable shell formed generally around an outline of the firearm. Each type of case is used for a specific purpose. A rigid case is ideal for shipping and long-term storage, while the deformable case is ideal for portable in-field transportation. As a result, a user is required to own both types of cases and chooses one over the other for certain activities when neither may be individually suited for the activity separately.

Rigid cases are generally formed from a metallic or plastic material having a base and lid connected by an elongated piano-type hinge. The interior is usually filled with a padding material conforming to the interior dimensions to provide cushioning and for securing the contents against movement within the case. This style of case provides increased protection at the expense of size and portability. However, there are several other disadvantages of a rigid case. A rigid case is heavy and non-deformable. As a result, these cases have limited utility, and are best suited for shipping by commercial carrier or for use in long-term storage. Such rigid cases are cumbersome to carry in the field, such as when a hunter must backpack or use an all-terrain vehicle. Further, piano-type hinges are subject to damage when improperly handled during the loading, storage or unloading of the case. The protective capability of a rigid case is compromised when the hinge is damaged.

A soft sided case is commonly formed of a layered composite, for example, a fabric, canvas, leather or leather-like exterior material and a foam or woolen-type of interior. These types of cases are light weight and flexible. Soft sided cases may be easily carried by a hunter in the field. The disadvantage of such soft sided cases is that they do not provide adequate security and protection for the contents during private or commercial shipping. Further, the soft sided cases are not suitable for mounting using brackets to an all-terrain vehicle.

As a result of existing case designs, a user may need to use both cases for an activity in the field. This is not only costly, but cumbersome and time consuming. Therefore, a need exists for a protective case that has benefits of a soft case, while at the same time offering the protection of a hard case to provide a case system having multiple capabilities.

SUMMARY OF THE INVENTION

In accordance with the present invention, a protective case includes first and second shell members which form a receiving space for the case. The receiving space includes a top wall boundary, a bottom wall boundary and first and second side wall boundaries. Each of the shell members includes a centrally disposed rigid portion having a top, a bottom, and oppositely disposed first and second sides. The top of the rigid portion of the shell members forms a portion of the top wall boundary of the receiving space. The bottom of the rigid portion of the shell members forms a portion of the bottom boundary of the receiving space. Each of the shell members further includes a first flexible portion extending from the first side of the rigid portion and forming a portion of the top wall boundary and the bottom wall boundary of the receiving space. The first flexible portion extends adjacent the first side wall boundary of the receiving space. Each of the shell members further includes a second flexible portion extending from the second side of the rigid portion and forming a portion of the top wall boundary and the bottom wall boundary of the receiving space. The second flexible portion extends adjacent to the second side wall boundary of the receiving space.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
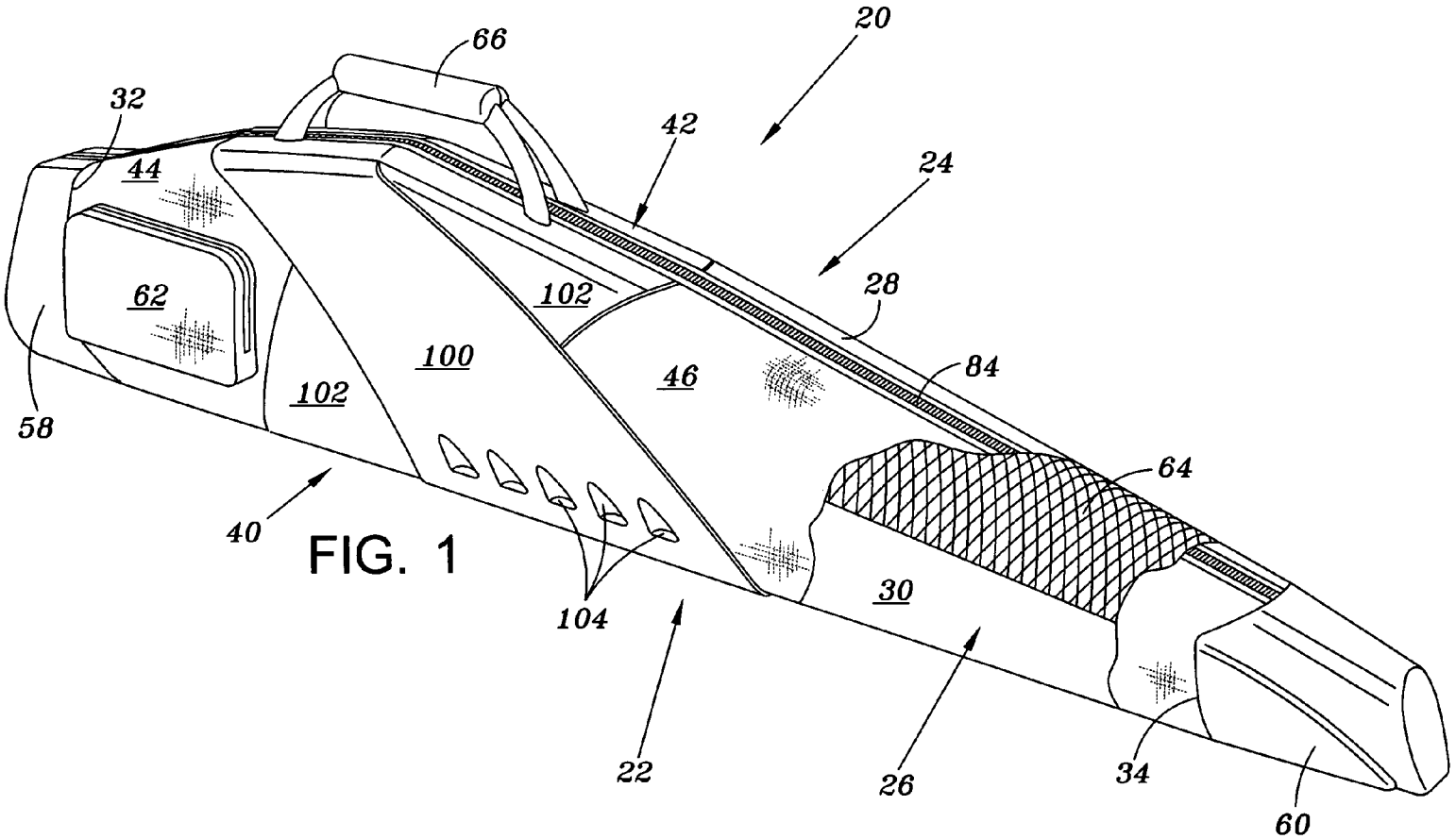
FIG. 1 is a perspective view of one embodiment in the form of a rifle case illustrating the present invention.
Figure 2:
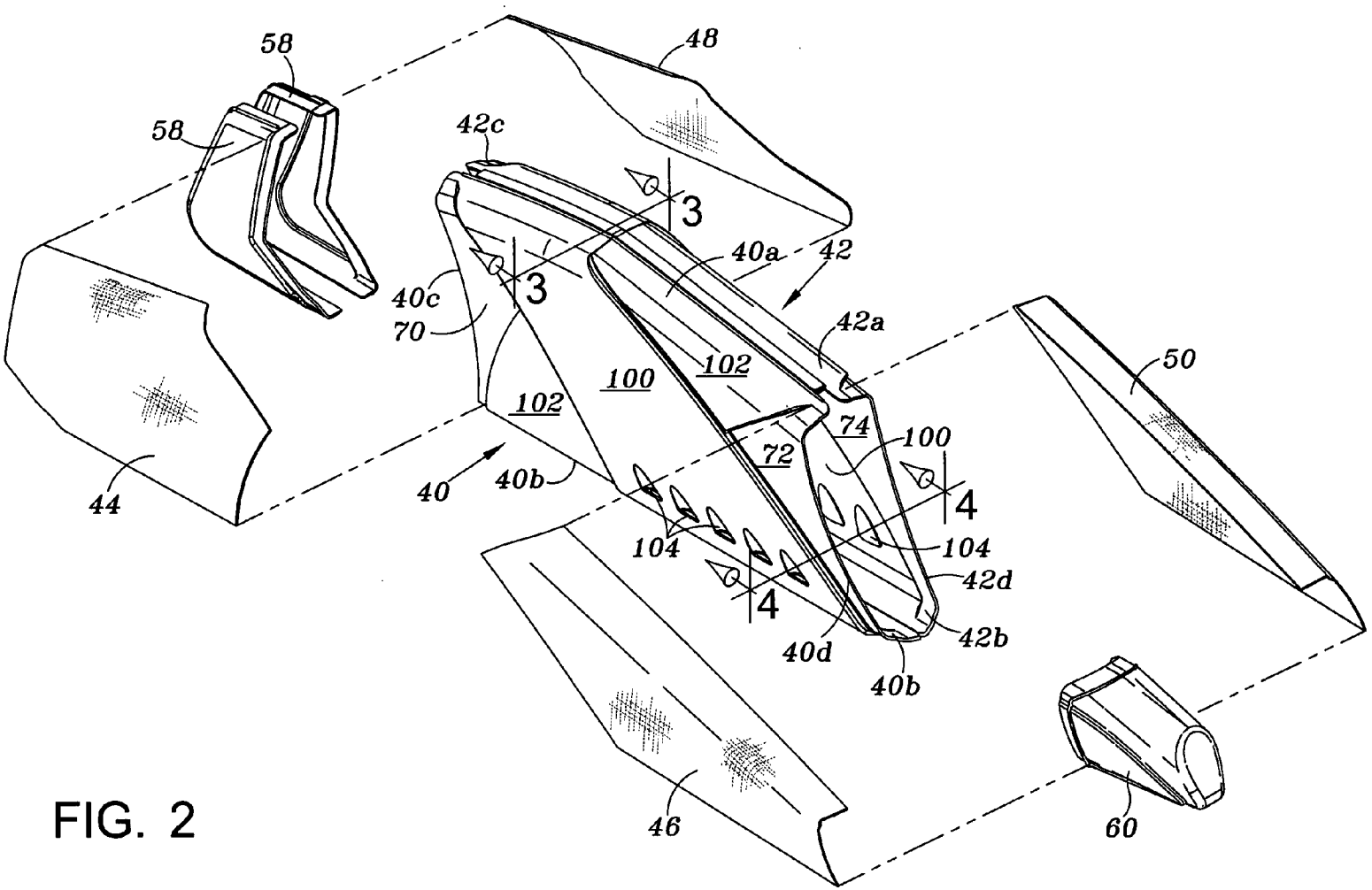
FIG. 2 is an exploded perspective view of the case illustrated in FIG. 1.
Figure 8:
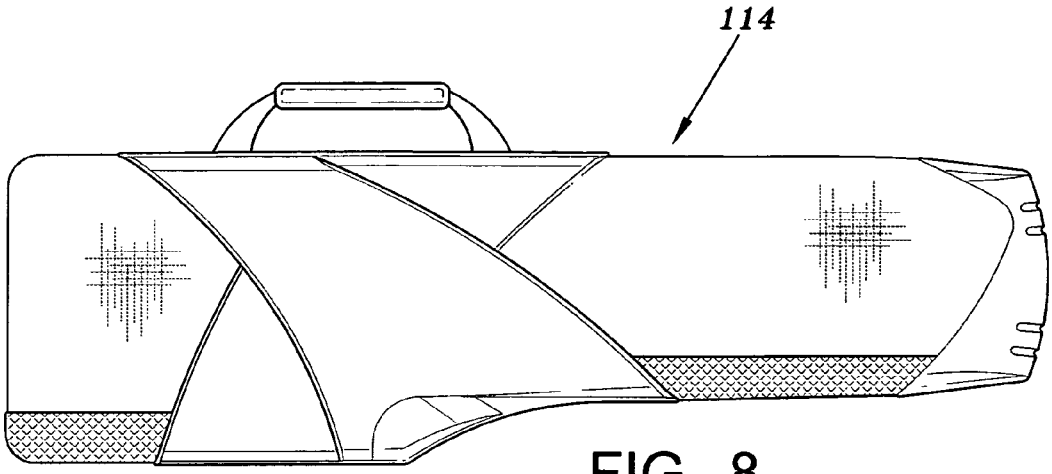
FIG. 8 is a perspective view of an additional embodiment of the present invention in the form of a take-down weapon case.
Figure 9:
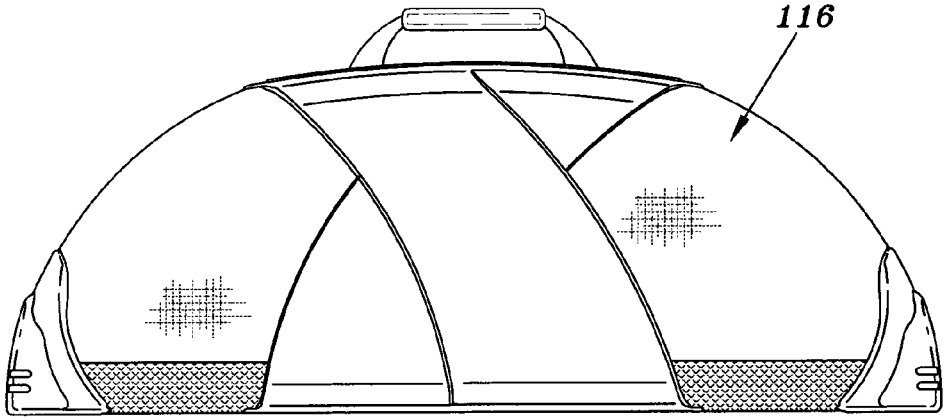
FIG. 9 is a perspective view of an additional embodiment of the present invention in the form of an archery bow case.
Figure 10:
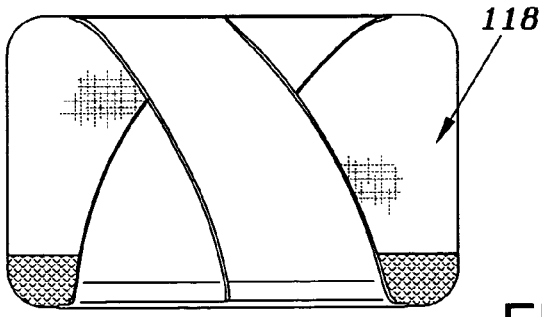
FIG. 10 is a perspective view of an additional embodiment of the present invention in the form of a handgun-equipment case.

Referring simultaneously to FIGS. 1 and 2, an embodiment of the present protective case is illustrated, and is generally identified by the numeral 20. Case 20 is utilized for carrying, storage and transportation of, for example, a rifle, it being understood that the present invention can be utilized for storage, transportation and carrying of a variety of items such as, for example, weapons, binoculars, cameras, and other types of equipment. Additional embodiments of the present case are illustrated in FIGS. 8, 9 and 10.

Protective case 20 includes a first shell member, generally identified by the numeral 22, and a second shell member, generally identified by the numeral 24. Shell members 22 and 24 define a receiving space, generally identified by the numeral 26 for housing the contents of case 20. Case 20 is defined by a top wall boundary 28, a bottom wall boundary 30, a first side wall boundary 32 and a second side wall boundary 34.

An important aspect of the present case 20 is the utilization of both rigid and flexible material forming shell members 22 and 24. Each shell member 22 and 24 includes a rigid portion. First shell member 22 includes a rigid portion, generally identified by the numeral 40. Second shell member 24 includes a rigid portion, generally identified by the numeral 42. First shell member 22 includes flexible portions 44 and 46. Second shell member 24 includes flexible portions 48 and 50. Rigid portions 40 and 42 may comprise, for example, high impact polypropylene plastic material. Flexible portions 44, 46, 48 and 50 may comprise, for example, fabric material. Rigid portions 40 and 42 are positioned along shell members 22 and 24 of case 20 to protect, for example, a weapon's scope/breech, muzzle, or stock area, and in the case of an archery bow, to protect the sites, strings or cam areas.

Additional protection for the contents of case 20 is provided by a rigid portion 58 positioned adjacent to first side wall boundary 32 and a rigid portion 60 positioned adjacent to second side wall boundary 34.

Case 20 is also provided with a pocket 62. Pocket 62 may also be positioned interiorly within receiving space 26 of case 20. Receiving space 26 is also covered with protective padding 64. A handle 66 extends from rigid portions 40 and 42.

Rigid portion 40 of first shell member 22 includes a top 40*a*, bottom 40*b*, first side 40*c* and second side 40*d*. Rigid portion 42 of second shell member 24 includes a top 42*a*, bottom 42*b*, first side 42*c* and a second side 42*d*.

Flexible portion 44 extends between first side 40*c* of rigid portion 40 and rigid portion 58. Flexible portion 44 is attached in an area 70 located adjacent to side 40*c* and overlaps rigid portion 40 in area 70 to increase the overall strength between the connection of flexible portion 44 and rigid portion 40. Similarly, flexible portion 48 extends between rigid portion 42 and rigid portion 58. Flexible portion 48 overlaps a portion of rigid portion 42 (not shown). Flexible portion 46 extends between rigid portion 40 and rigid portion 60. Flexible portion 46 overlaps a portion of rigid portion 42 in area 72 adjacent second side 40*d* of rigid portion 40. Similarly, flexible portion 50 extends between rigid portion 42 and rigid portion 60 of case 20. A portion of flexible portion 50 overlaps an area 74 of rigid portion 42. Flexible members 44, 46, 48 and 50 are attachable to rigid portions 40, 42, 58 and 60 by using various attachment methods, such as, for example, sewing, gluing, riveting, heat staking, or stapling.

Figure 4:
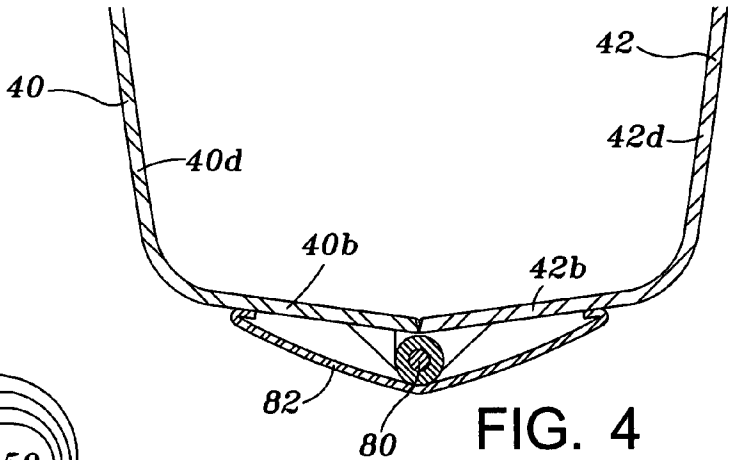
FIG. 4 is a cross-sectional view taken generally along section lines 4-4 of FIG. 2.

Referring now to FIGS. 2 and 4, shell members 22 and 24 are hingedly joined along bottom 40*b* and 42*b* of rigid portions 40 and 42, respectively, utilizing a hinge 80. Hinge 80, may comprise, for example, a piano-type hinge. Hinge 80 is covered by a protective covering 82 which may comprise, for example, an ethylene vinyl acetate material. Cover 82 prevents dirt and debris from interfering with the operation of hinge 80.

Figure 3:
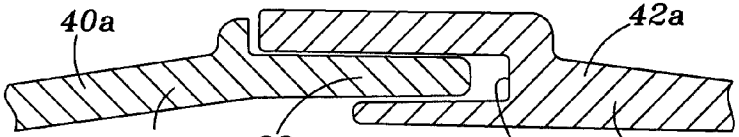
FIG. 3 is a cross-sectional view taken generally along section lines 3-3 of FIG. 2.

Shell members 22 and 24 are joined at the top wall boundary 28 of protective case 20 utilizing a zipper 84 (FIG. 1). In order to provide a secure closure for case 20, rigid portions 40 and 42 provide a locking feature along top 40*a* and top 42*a* in the form of a tongue and groove connection. As shown in FIG. 3, top 42*a* of rigid portion 42 includes a groove 86 for receiving a tongue portion 88 of top 40*a* of rigid portion 40 to form a positive mechanical connection and provide extra rigidity to case 20.

Additional support is provided for case 20 due to the use of multiple surfaces created in rigid portions 40 and 42. Rigid portions 40 and 42 include diagonal strips 100 and 102 which increase the rigidity of rigid portions 40 and 42. Strips 100 and 102 are integrally formed. Diagonal strip 100 includes recesses 104 which provide additional surfaces and additional strength for rigid portions 40 and 42.

Figure 6:
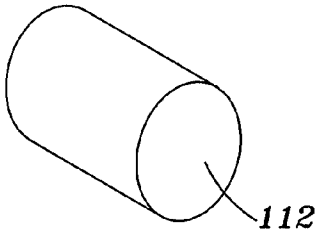
FIG. 6 is a perspective view of an insert for adjusting the size of the case shown in FIG. 1.
Figure 5:
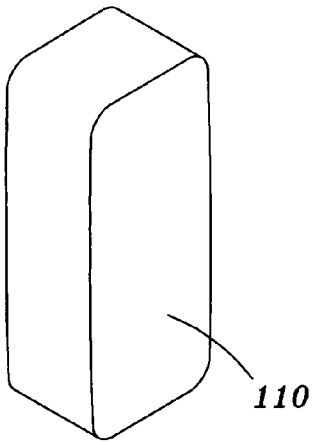
FIG. 5 is a perspective view of an insert for adjusting the size of the case illustrated in FIG. 1.

In order to adjust the length of receiving space 26 of case 20, inserts 110 (FIG. 5) and 112 (FIG. 6) can be inserted within receiving space 26 adjacent to rigid portion 58 and rigid portion 60, respectively, in order to decrease the overall length of receiving space 26.

Figure 7:
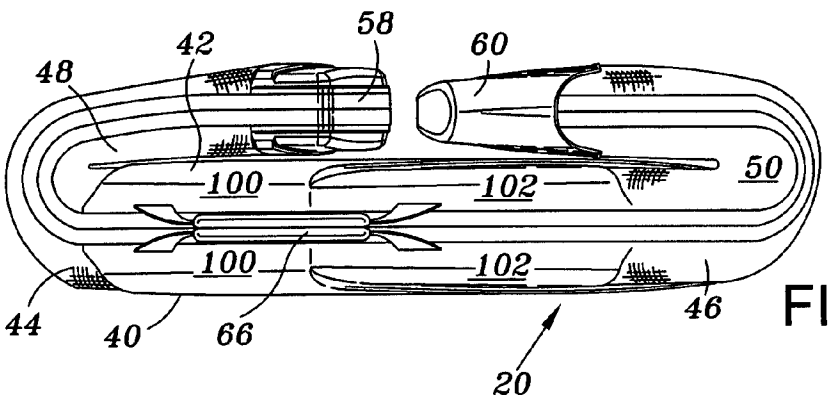
FIG. 7 is a top plan view of the case shown in FIG. 1 in a folded position.

Due to the use of flexible portions 44, 46, 48 and 50, case 20 can be folded as illustrated in FIG. 7 to a compact configuration when not in use.

Additional embodiments of case 20 for use with different contents are illustrated in FIGS. 8, 9 and 10. FIG. 8 illustrates a take down weapon case 114, FIG. 9 illustrates an archery bow case 116 and FIG. 10 illustrates a handgun, camera, equipment case 118. Cases 114, 116 and 118 each include a combination of rigid and flexible portions as described with respect to case 20.

Other alteration and modification of the invention will likewise become apparent to those of ordinary skill in the art and upon reading the present disclosure, and it is intended that the scope of the invention disclosed herein be limited only by the broadest interpretation of the appended claims to which the inventor is legally entitled.

We claim:

1. A protective case comprising:

a first shell member and a second shell member connected generally in a clam shell manner thereby cooperatively defining a receiving space of the case therebetween, the first and second shell members cooperatively forming a top wall boundary, a bottom wall boundary, a first side wall boundary and a second side wall boundary of the case;

each of said first and second shell members includes a centrally disposed rigid portion, each of said rigid portions having a top, a bottom, and oppositely disposed first side and second side, said tops of said rigid portions of said shell members cooperatively form a portion of said top wall boundary of the case and said bottoms of said rigid portions of said shell members cooperatively form a portion of said bottom wall boundary of the case;

each of said first and second shell members further includes a first flexible portion, each of said first flexible portions extends from said first side of said rigid portion to adjacent said first side wall boundary of the case so as to form a portion of said top wall boundary and said bottom wall boundary of the case;

each of said first and second shell members further includes a second flexible portion, each of said second flexible portions extends from said second side of said rigid portion to adjacent said second side wall boundary of the case so as to form a portion of said top wall boundary and said bottom wall boundary of the case; and a zipper disposed along the top wall boundary and extending from the first side wall boundary to the second side wall boundary, wherein the zipper operatively connects the rigid portion and first and second flexible portions of the first shell member to the respective corresponding rigid portion and first and second flexible portions of the second shell member.

2. The case of claim 1 wherein said first and second flexible portions overlap an area of said rigid portion on each side of said shell members.

3. The case of claim 1 wherein said rigid portions of said first and second shell members include a hinge along said bottom of said rigid portions.

4. The case of claim 3 wherein said hinge includes a protective covering.

5. The case of claim 1 wherein said top of said rigid portion of said first shell member includes a groove and said top of said rigid portion of said second shell member is received within said groove.

6. The case of claim 1 and further including: a rigid portion disposed along said first side wall boundary of said case.

7. The case of claim 1 and further including: a rigid portion disposed along said second side wall boundary of said case.

8. The case of claim 1 wherein said bottom of said rigid portions includes a plurality of indentations.

9. The case of claim 1 wherein said receiving space includes a spacer disposed adjacent of one of said side wall boundaries for adjusting the size of said receiving space.

10. The case of claim 1 wherein said rigid portions include polypropylene plastic material and said flexible portions include fabric material.

11. The case of claim 1 and further including: a handle attached to said rigid portions adjacent said top wall boundary of the case.

12. The case of claim 1 and further including storage compartments.

13. The case of claim 1 and further including protective padding disposed within the receiving space.

14. The case of claim 1 wherein said rigid portions include first and second interconnecting diagonal strips.

15. The case of claim 1 wherein said first and second flexible portions are foldable to overlay said rigid portions.

* * * * *